US006398510B1

(12) United States Patent
Liebig et al.

(10) Patent No.: US 6,398,510 B1
(45) **Date of Patent: *Jun. 4, 2002**

(54) METHOD AND SYSTEM FOR AVOIDING CAVITATION IN A PUMP CONVEYING SATURATED WATER

(75) Inventors: Erhard Liebig, Laufenburg-Binzgen; Jens Wötzel, Dogern, both of (DE)

(73) Assignee: Alstom, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/448,492

(22) Filed: Nov. 24, 1999

(30) Foreign Application Priority Data

Nov. 25, 1998 (DE) ..... 198 54 383

(51) Int. Cl.[7] ..... F04B 19/24; F04B 49/10; F04B 49/00

(52) U.S. Cl. ..... 417/53; 417/32; 417/38

(58) Field of Search ..... 417/53, 13, 32, 417/38

(56) References Cited

U.S. PATENT DOCUMENTS 4,552,099 A * 11/1985 Martens et al. ..... 122/451.1
5,332,356 A 7/1994 Gülich ..... 415/118
5,360,057 A * 11/1994 Rockenfeller et al. . 165/104.12

FOREIGN PATENT DOCUMENTS

| | | | |
|---|---|---|---|
| DE | 1 070 497 | 12/1959 | |
| DE | 33 04705 A1 | 8/1984 | |
| DE | 43 00 560 | 7/1993 | |
| EP | 0 554 640 | 8/1993 | |
| EP | 0 321 295 | 6/1999 | |
| JP | 54-132002 | * 10/1979 | ..... 122/406.2 |
| JP | 54-162039 | * 10/1979 | ..... 415/910 |

* cited by examiner

*Primary Examiner*—Charles G. Freay
*Assistant Examiner*—Michael K. Gray
(74) *Attorney, Agent, or Firm*—Burns, Doane, Swecker & Mathis, L.L.P.

(57) ABSTRACT

A tank (1) having saturated water (2) is connected to a pump (5) via a suction line (4). The actual values of the pressure and/or temperature in the tank (1) are detected to a measuring arrangement (7) and supplied to a control apparatus (8), in which the actual values are compared with fixed values. In a water reservoir (9) there is admixing water, the temperature of which is lower than the actual temperature in the tank (1). This water reservoir (9) is connected to the suction line (4) via an inflow line (11). An actuator (12) which is activated by the control apparatus (8) is arranged in the inflow line (11). When the actual values in the tank (1) reach the fixed values, so that the pump (5) could experience cavitation, the actuator (12) is opened by means of the control apparatus (8), in order to introduce admixing water into the suction line (4).

10 Claims, 1 Drawing Sheet

METHOD AND SYSTEM FOR AVOIDING CAVITATION IN A PUMP CONVEYING SATURATED WATER

BACKGROUND OF THE INVENTION

1. Field of the Invention

The present invention relates to a method and a system for avoiding cavitation in a pump conveying saturated water, said pump being connected to a saturated water source via a suction line. The invention relates, furthermore, to a thermal power station having such a system.

2. Discussion of Background

What is referred to as cavitation is the formation of steam bubbles and the decomposition of steam bubbles in a flowing liquid in the event of a change in pressure and/or velocity. If the pressure falls below the steam pressure of the liquid as a result of friction, due to the acceleration of a flowing liquid, etc., steam bubbles form in the liquid. If there is a subsequent pressure rise, for example as a result of a deceleration of the liquid, condensation of the steam bubbles takes place. On account of a sudden change in volume, this process is accompanied by very strong pressure pulses which may cause considerable damage, for example in a pump conveying this liquid.

At various points in thermal power stations, water in the state of saturation is conveyed, this being accompanied by an increase in pressure, and there is therefore the risk of cavitation.

The feed of regenerative preheaters from a feedwater tank/deaerator or condenser or the feed of an evaporator system from an evaporator, drum may be mentioned as examples.

Pressure fluctuations in the inflow system of the pumps of the abovementioned parts of a plant may lead to evaporation of this kind and therefore cavitation. Such pressure fluctuations may be caused, for example, by rapid load changes during the startup and shutdown of a thermal power station or by the sudden discharge of large steam quantities from the evaporator drum of a steam generator due to extraction or blowoff.

Pump damage caused by cavitation has hitherto been prevented by regulating the pressure in the inflow system, in particular by limiting the pressure drop on the suction side of the pumps and by monitoring the conveying behavior of the pump, including triggering a safety shutdown in the event of inadmissible conveying conditions.

Known devices for regulating the pressure in the inflow system cannot always, particularly in the event of brief malfunctions, ensure the necessary conditions for the pump to operate satisfactorily, and this may lead to a safety shutdown. However, a safety shutdown of pumps in a plant is undesirable.

SUMMARY OF THE INVENTION

The object of the invention is to provide a method and a system for avoiding cavitation in a pump conveying saturated water, said system ensuring that the pump continues to operate in the event of inadmissible pressure changes in the inflow system of the pump, for example due to a delayed, faulty or inadequate response of the means of regulating the pressure in the inflow system. A further object is to provide a thermal power station having such a system.

This is achieved, according to the invention, in that the actual values of the pressure and/or temperature of the saturated water in at least the saturated water source are detected and are compared with fixed pressure and/or temperature values which are conducive to cavitation, and, in the event that the actual values reach the fixed values, admixing water is supplied to the pump on the suction side, the temperature of said admixing water being lower than the fixed temperature value.

The system for carrying out the method is distinguished by an admixing water source which is connected to the suction line via an inflow line having an actuator. A valve, flap, slide and the like may be used as an actual form of construction of the actuator.

A thermal power station having such a system is distinguished in that the admixing water source is a water reservoir which is a water-containing tank or a water-containing system located upstream of the saturated water source in the throughflow direction of the water or steam circuit or arranged within the auxiliary systems of the power station.

The admixing water may be supplied, for example, by pumping, by sucking in the admixing water by means of a pressure difference prevailing between the admixing water source and the admixing point upstream of the pump, by means of a height difference between the admixing water source arranged in a plant and the admixing point upstream of the pump, or by a combination of these possibilities.

In a thermal power station having such a system, the admixing water source may be located upstream of the saturated water source in the throughflow direction of the water/steam circuit or be a low-temperature water reservoir arranged within the auxiliary systems of the power station, for example a water-containing tank, a water system, a water tank, a water line, etc.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
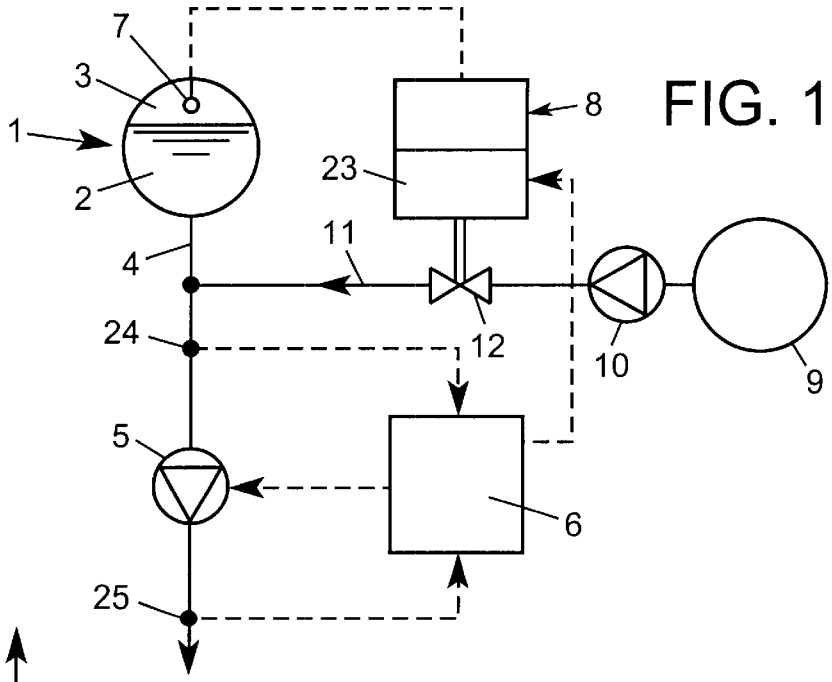
FIG. 1 shows, purely diagrammatically, a design of the system according to the invention.

Referring now to the drawings, wherein like reference numerals designate identical or corresponding parts throughout the several views, saturated water 2 is located in a tank designed as a saturated water source 1 and pressurized steam 3 is located above the saturated water 2. The saturated water 2 is conveyed out of the tank 1 via a suction line 4 and by means of a pump 5 designed as a saturated water pump and is supplied to any consumer.

Arranged in the tank 1, then, is a pressure and/or temperature detecting measuring arrangement 7, the output of which is supplied to a control apparatus 8. In this control apparatus 8, the permissible values for the pressure and/or temperature in the tank 1 are stored or are calculated on the basis of the current system data. During operation, then, these stored or calculated values, that is to say fixed values, are compared with the actual values of the pressure and/or temperature in the tank 1.

Reference number 9 designates a water reservoir serving as an admixing water source, the temperature of the admixing water being lower than the temperature of the saturated water 2 in the tank 1.

This water reservoir 9 is connected via an inflow line 11 to the suction line 4 at a point upstream of the saturated water pump 5. A pump 10 is indicated as a member for conveying the admixing water from the water reservoir 9 into the suction line 4. However, this pump 10 is to be considered merely as an example. The admixing water may also be conveyed by means of a suction effect, a pressure difference prevailing between the water reservoir 9 and the suction line 4, and also be means of a system-induced height difference between the water reservoir 9 and the suction line 4 and the like.

An actuator 12 is arranged in the inflow line 11. According to a preferred design, this actuator 12 is controlled by the control apparatus 8 as follows:

In a comparison unit 23 of the control apparatus 8, the detected actual values of the pressure and/or temperature in the tank 1 are compared with the fixed values.

When said actual values reach the fixed values in the saturated water tank 1, the admixing water may initially be admixed by means of a simple open/shut control of the actuator 12.

Furthermore, in the control apparatus 8 the quantity of admixing water (the temperature of which is likewise stored or measured in the control apparatus 8) necessary for obtaining the desired values is calculated, and, as a result of a controlled opening of the actuator 12 (approach to an actual position of the actuator), the necessary admixing water quantity is metered to the saturated water 2 flowing through the suction line 4.

Consequently, the temperature of the saturated water 2 conveyed through the saturated water pump 5 is maintained at values which reliably avoid cavitation.

When conditions undoubtedly not leading to the cavitation of the saturation water pump 5 have been established in the tank 1 again, the actuator 12 is closed again via the control apparatus 6.

FIG. 1 also shows a monitoring device 6. This monitoring device 6 determines and monitors the operating states upstream and/or downstream of the saturated water pump 5 by determining the pressure and/or temperature upstream upstream and/or downstream of the saturated water pump 5 by means of corresponding measuring arrangements 24, 25.

These determined values are additionally supplied to the control apparatus 8 and compared with corresponding desired values in the comparison unit 23. In this case, the actuator 12 is designed as a regulating member, in that, by testing the conditions at the saturated water pump 5 and comparing them with the desired values, a correction is made to the position of the actuator 12, that is to say the mass flow from the water reservoir 9 to the suction line 4 is regulated, that is to say changed as a function of the values determined by the measuring arrangement 24 and/or the measuring arrangement 25.

If the maximum possible quantity of admixing water is not sufficient to prevent cavitation, the saturated water pump 5 is shut down by means of the monitoring device 6.

Figure 2:
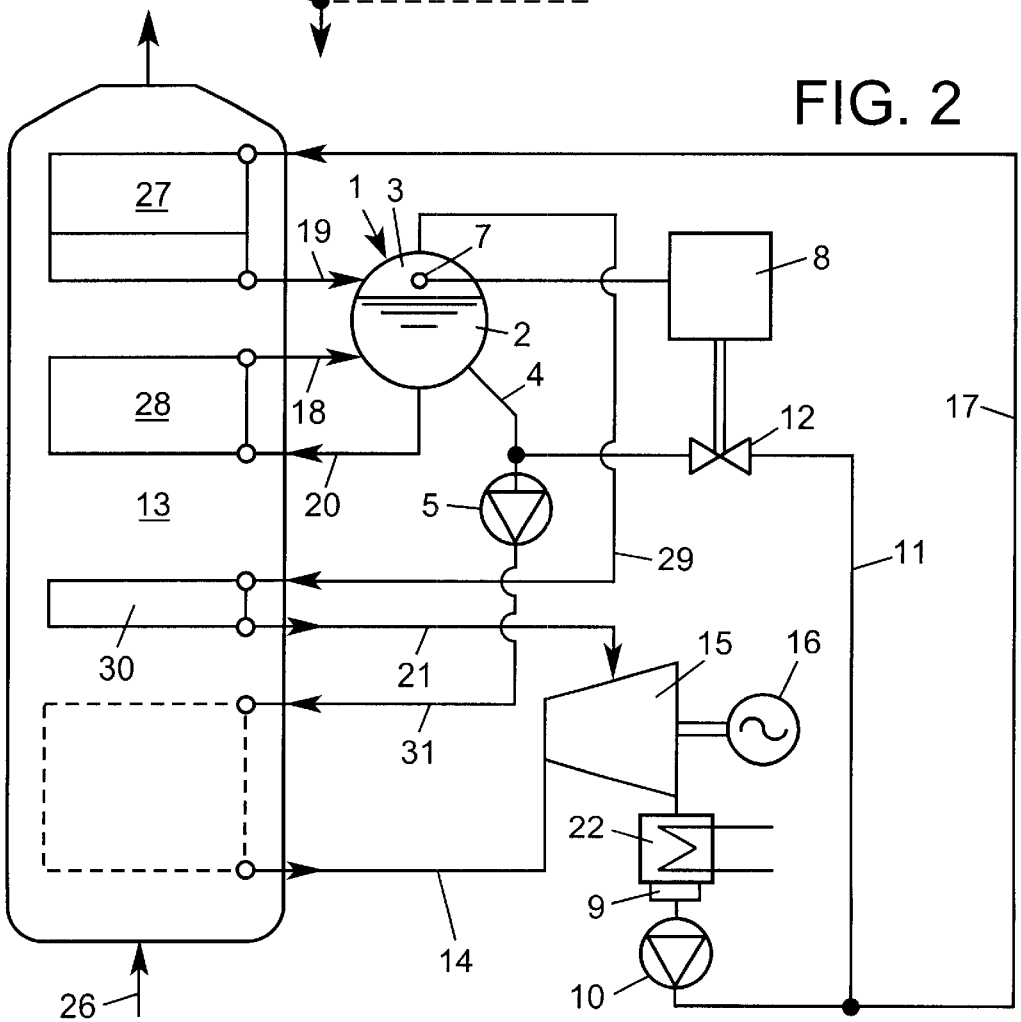
FIG. 2 shows, purely diagrammatically, a thermal power station having a system according to FIG. 1, only the units necessary for understanding the invention being indicated

FIG. 2 shows diagrammatically, and greatly simplified, a thermal power station which has (at least) one system as described above. The same reference numerals as in FIG. 1 are used here as far as possible.

The thermal power station has a steam generator 13 heated by fuel gas 26 (for example, flue gas or waste gas from a gas turbine), the steam flowing via a fresh steam line 14 to a steam turbine 15 which is connected to a generator 16. The exhaust steam from the steam turbine 15 flows into a condenser 22 having a hot well 9 which corresponds to the admixing water source (water reservoir) of FIG. 1. The hot well 9 is followed by a feedwater pump 10, again corresponding to the design shown in FIG. 1. A feedwater line 17 leads from the feedwater pump 10 back to the steam generator 13, for example to the economizer 27 of the latter.

The steam generator 13 has a steam drum 1 as an example of a tank containing saturated water 2. An inflow line 19 leads from the economizer 27 to the steam drum 1. An outflow line 20 leads from the steam drum 1 to the low pressure evaporator 28, and an inflow line 18 leads from the low pressure evaporator 28 back to the steam drum 1 in a known way. Furthermore, a low pressure steam line 29 runs from the steam drum 1 to a superheater 30, and a low pressure steam line 21 runs from the superheater 30 to the steam turbine 15.

A feedwater line 31 leads from the saturated water pump 5 into the high pressure system, indicated merely by broken lines, of the steam generator 13, and, finally, reference numeral 14 designates the high pressure fresh steam line coming from the high pressure system.

The steam drum 1 is assigned the control apparatus 8 which controls the actuator 12 arranged in the inflow line 11 (see also FIG. 1) which, coming from the feedwater line 17 in this design shown, opens into the suction line 4, in order, as required, to supply colder admixing water to the suction line 4 in order to prevent cavitation of the saturated water pump It should be noted that the steam generator described may be of any known design, that is to say is not restricted to the heating surface concept described.

Obviously, numerous modifications and variations of the present invention are possible in light of the above teachings. It is therefore to be understood that, within the scope of the appended claims, the invention may be practiced otherwise than is specifically described herein.

What is claimed as new and desired to be secured by Letters Patent of the United States is:

1. A method for avoiding cavitation in a pump which is connected to a saturated water source on the suction side, said method comprising the steps of:

detecting acted values of a pressure and/or temperature of the saturated water in at least the saturated water source;

comparing the detected actual values with predetermined fixed pressure and/or temperature values which are conducive to cavitation in the pump; and supplying admixing water to the pump on the suction side in the event that the detected actual values reach the predetermined fixed values, the temperature of said admixing water being lower than the predetermined fixed temperature value.

2. The method as claimed in claim 1, further including the steps of:

determining whether a change in the detected actual values falls within a predetermined unacceptable range; and if the change in the detected actual values falls within an unacceptable range, supplying a fixed invariable mass flow of admixing water to the pump on the suction side until the detected actual values are in a range which is not conducive to cavitation.

3. The method as claimed in claim 1, further including the steps of:

determining whether a change in the detected actual values falls within a predetermined unacceptable range; and if the change in the detected actual values falls within an unacceptable range, supplying a mass flow of admixing water dependent on the degree of deviation of the detected actual values from an acceptable range to the pump on the suction side until the detected actual values are in a range not conducive to cavitation.

4. The method as claimed in claim 1, further including the steps of:

determining whether a change in the detected actual values falls within a predetermined unacceptable range; and if the change in the detected actual values falls within an unacceptable range, supplying a quantitatively regulated mass flow of admixing water to the pump on the suction side until the detected actual values are in a range not conducive to cavitation.

5. The method as claimed in claim 1, further including the steps of:

detecting further actual values of pressure and/or temperature upstream and/or downstream of the pump;

comparing the detected further actual values with further predetermined fixed values of pressure and/or temperature upstream and/or downstream of the pump which are conducive to cavitation in the pump; and supplying admixing water to the suction side of the pump in the event that the further detected actual values reach the further predetermined fixed values, the temperature of the admixing water being lower than the predetermined fixed value of temperature.

6. The method as claimed in claim 1, further including the steps of:

detecting further actual values of pressure and/or temperature upstream and/or downstream of the pump;

comparing the detected further actual values with flirter predetermined fixed values of pressure and/or temperature upstream and/or downstream of the pump which are conducive to cavitation in the pump;

determining whether a maximum possible mass flow of admixing water is sufficient to prevent cavitation; and when the further predetermined fixed values are exceeded despite the maximum possible mass flow of admixing water capable of being supplied, the pump is shut down.

7. A system for avoiding cavitation in a pump, said system comprising:

a saturated water source;

a pump connected to the saturated water source via a suction line;

an admixing water source connected to the suction line via an inflow line having an actuator, a control apparatus, said control apparatus including a measuring arrangement for detecting actual values of the pressure and/or temperature of the water in the saturated water source and a comparison unit for comparing predetermined fixed pressure and/or temperature values which are conducive to cavitation in the pump with the detected actual values, said comparison us it transferring the actuator from a closed position to an open position when the detected actual values reach the predetermined fixed values so as to make it possible for admixing water at a lower temperature than the detected actual temperature to flow in an invariable mass flow into the suction line, and transferring the actuator from the open position to the closed position again after the detected actual values of the pressure and/or temperature of the water in the saturated water source have been changed to values not conducive to cavitation.

8. The system according to claim 7, said system further including:

a monitoring device, said monitoring device including measuring arrangements for detecting further actual values of the pressure and/or temperature upstream and/or downstream of the pump, said monitoring device being connected to the control apparatus to transfer the actuator from a closed position to an open position or to bring about a regulation of the position of the actuator to allow the passage of a mass flow of admixing water dependent on the further actual values detected, and said monitoring device further serving to shut down the pump in the case of an insufficient quantity of admixing water supplied.

9. A thermal power station having a system as claimed in claim 8, wherein the admixing water source is a water reservoir which is a water-containing tank or a water-containing system located upstream of the saturated water source in a throughflow direction of a water/steam circuit or arranged within the auxiliary systems of the power station.

10. A system for avoiding cavitation in a pump, said system comprising:

a saturated water source;

a pump connected to the saturated water source via a suction line;

an admixing water source connected to the suction line via an inflow line having an actuator;

a control apparatus, said control apparatus including a measuring arrangement for detecting actual values of the pressure and/or temperature of the water in the saturated water source and a comparison unit for comparing predetermined fixed pressure and/or temperature values which are conducive to cavitation in the pump with the detected actual values, said comparison unit changing the position of the actuator in the event that the detected actual values reach the predetermined fixed values, the position of the actuator being one in which a mass flow, determined in the control apparatus as a function of the detected actual values, of the admixing water at a lower temperature than the detected actual value, is supplied to the suction line.

* * * * *